US007010866B1

(12) United States Patent
Lin

(10) Patent No.: US 7,010,866 B1
(45) Date of Patent: Mar. 14, 2006

(54) VOLTAGE STEP-DOWN STRUCTURE FOR A HEAT-EMITTING ELEMENT OF A DRIER

(76) Inventor: Hsin-Yun Lin, PO Box 82-144, Taipei (TW)

( * ) Notice: Subject to any disclaimer, the term of this patent is extended or adjusted under 35 U.S.C. 154(b) by 0 days.

(21) Appl. No.: 10/947,154

(22) Filed: Sep. 23, 2004

(51) Int. Cl.
*A45D 20/12* (2006.01)

(52) U.S. Cl. ..... 34/96; 392/384; 392/385; 340/660

(58) Field of Classification Search ..... 34/96–100; 392/384, 385; 340/660
See application file for complete search history.

(56) References Cited

U.S. PATENT DOCUMENTS 3,539,767 A * 11/1970 Eisler ..... 219/213
5,349,161 A * 9/1994 Bockholt ..... 219/385
5,359,788 A * 11/1994 Gell, Jr. ..... 34/360
6,389,710 B1 * 5/2002 Chou ..... 34/97

* cited by examiner

*Primary Examiner*—S. Gravini
(74) *Attorney, Agent, or Firm*—Leong C. Lei

(57) ABSTRACT

A voltage step-down structure for a heat-emitting element of a drier is disclosed. The structure is for a heat-emitting element of a drier having a hollow body containing a motor and a ceramic heat-emitting element and a voltage step-down device characterized in that the interior of the hollow body is mounted with the heat-emitting element and the ceramic or glass voltage step-down element coated with conductive film such that one end of the power source is connected to one end of the step-down element, and the other end is connected to the diode end of the motor such that the impedance of the conductive film provides voltage step-down.

5 Claims, 2 Drawing Sheets

VOLTAGE STEP-DOWN STRUCTURE FOR A HEAT-EMITTING ELEMENT OF A DRIER

BACKGROUND OF THE INVENTION (a) Technical Field of the Invention

The present invention relates to a voltage step-down structure, and in particular, a voltage step-down structure in heat-emitting element made from ceramic or glass material.

(b) Brief Description of the Prior Art

FIG. 4 shows a conventional hair drier including a tubular body 30 having an outlet 31 at one end and an inlet at the other end mounted with a filter 32. The interior of the body 30 is a motor 33 mounted with blades 34 to withdraw air when the blades 34 rotate. The voltage step-down device with resistance coil 35 is mounted at the inner edge of the outlet, and a control switch 38 is connected to the handle 37 of the drier to form the driving device of the power supply.

The voltage for such motor 33 has to be stepped down to meet the practical application. Thus, a voltage step down wire is needed and such a wire is generally a resistance coil 35. The drawbacks of such arrange of the resistance coil are that the mounting of the coil is difficult and the heat is generated. This will destroy the ceramic heat-emitting member of the drier.

Accordingly, it is an object of the present invention to provide a voltage step-down structure for a heat-emitting element of a drier which mitigates the above drawback.

SUMMARY OF THE INVENTION

Accordingly, it is an object of the present invention to provide a voltage step-down structure for a heat-emitting element of a drier having a hollow body containing a motor and a ceramic heat-emitting element and a voltage step-down device characterized in that the interior of the hollow body is mounted with the heat-emitting element and the ceramic or glass voltage step-down element coated with conductive film such that one end of the power source is connected to one end of the step-down element, and the other end is connected to the diode end of the motor such that the impedance of the conductive film provides voltage step-down.

Yet still another object of the present invention is to provide a voltage step-down structure for a heat-emitting element of a drier, wherein the voltage step-down element is either tubular or plate-like and the center of the heat-emitting member is a through hole.

Still another object of the present invention is to provide a voltage step-down structure for a heat-emitting element of a drier, wherein the through hole has a corresponding shape to that of the voltage step-down element, and the edge of the through hole is mounted with an insulation member.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
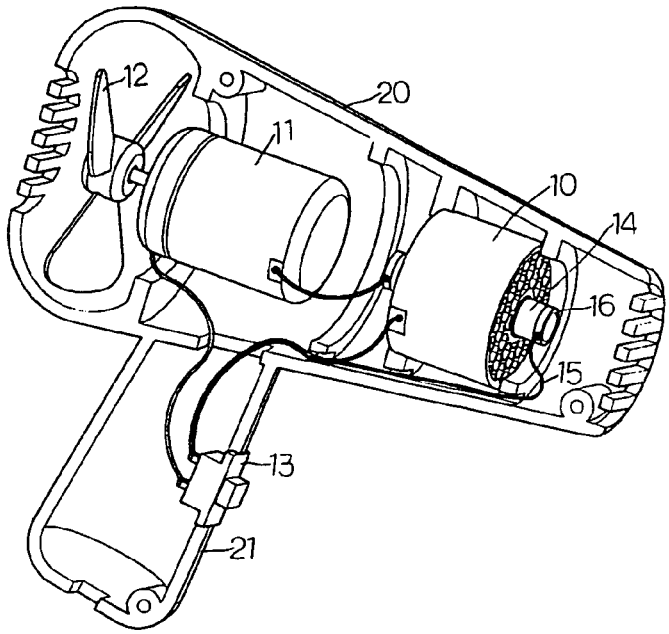
FIG. 1 is a schematic view of the drier in accordance with the present invention.
Figure 2:
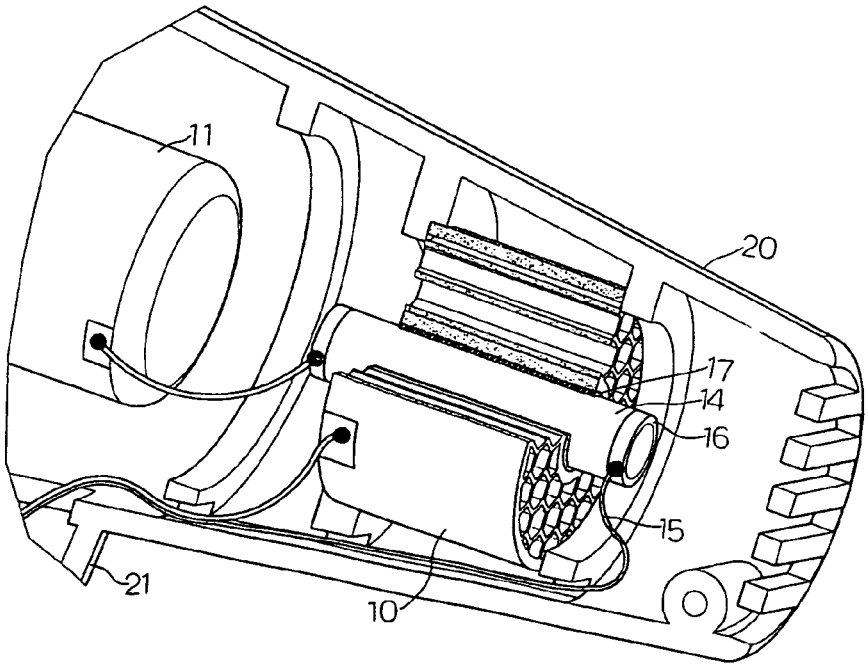
FIG. 2 is an enlarged view of the voltage step-down device in accordance with the present invention.
Figure 3:
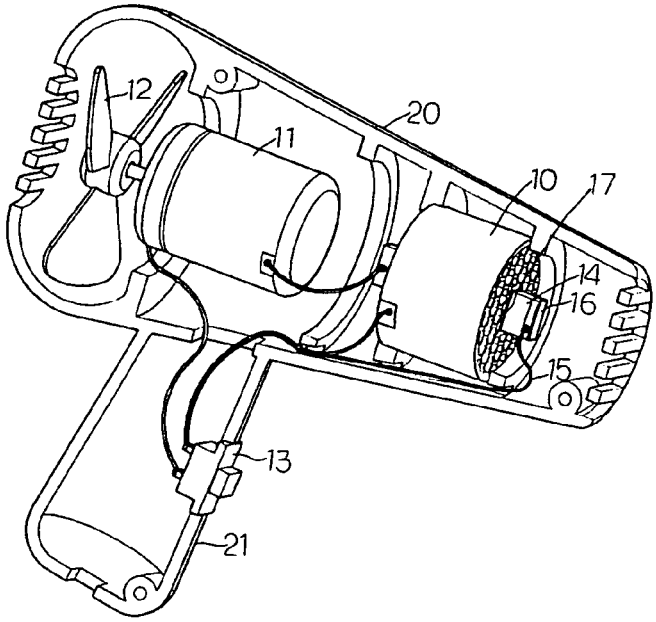
FIG. 3 is another preferred embodiment of voltage step-don device in accordance with the present invention.
Figure 4:
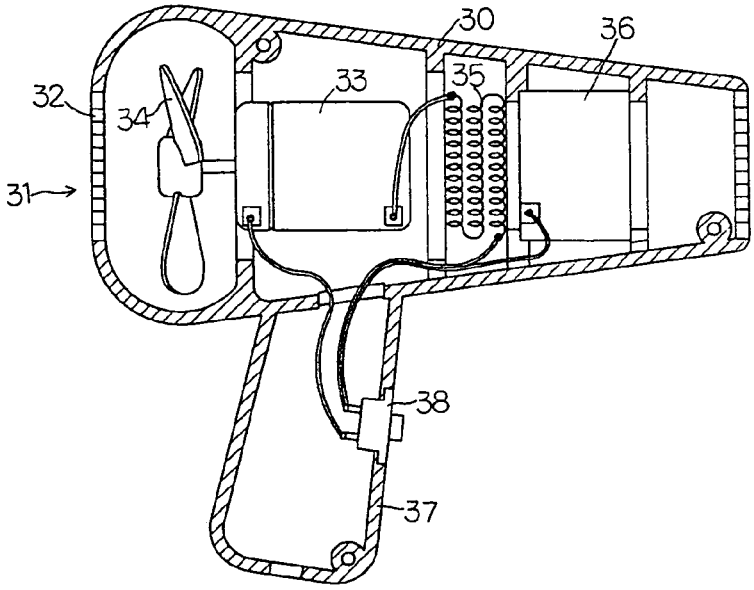
PRIOR ART FIG. 4
FIG. 4 is a sectional view of a conventional drier in accordance with the present invention.

Referring to FIGS. 1 and 2, there is shown a voltage step-down structure for a heat-emitting element of a drier including a hollow tubular body 20 containing a heat-emitting member 10, a motor 11 and blades 12. The bottom of the body 20 is extended to form a handle 21 mounted with a switch 13.

In accordance with the present invention, the heat-emitting member 10 and the motor 11 should be provided with a voltage step-down device such that the motor 11 is safe in continuously operation. The voltage step-down element 16 is made from ceramic or glass material and is arranged as tubular or plate-like. The external surface of the voltage step-down element 16 is coated with a conductive film 14 such that a terminal wire is connected from one end and the other end is connected to the diode within the motor 11 via a wire 15 and is used as the voltage step-down operation for the DC motor. The center of the heat-emitting body 10 has a through hole having a shape corresponding to the voltage step-down element 16. The edge of the hole is mounted with an insulation element 17 so that the voltage step-down element 16 can be directly mounted. A lead wire is connected from the switch 13 and is then connected to the heat-emitting member 10 and one end of the voltage step-down element 16. The other end of the voltage step-down member 16 is connected to the diode end of the motor 11. Thus the impedance of the voltage step-down member 16 can step-down the voltage for safety application.

Thus, the drier is simple in structure and the installation of components is simple. The heat-emitting body 10 can be connected to the voltage step-down element 16 so that the size of the body 20 of the drier is made smaller.

In accordance with the present invention, the ceramic or glass material voltage step-down element 16 can be connected directly with the heat-emitting member 10 such that the entire structure of the drier is small and simplified.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A voltage step-down structure for a heat-emitting element of a drier having a hollow body containing a motor and a ceramic heat-emitting element and a voltage step-down device characterized in that the interior of the hollow body is mounted with the heat-emitting element and the ceramic or glass voltage step-down element coated with conductive film such that one end of the power source is connected to one end of the step-down element, and the other end is connected to the diode end of the motor such that the impedance of the conductive film provides voltage step-down.

2. The voltage step-down structure of claim 1, wherein the voltage step-down element is either tubular or plate-like.

3. The voltage step-down structure of claim 1, wherein the center of the heat-emitting member is a through hole.

4. The voltage step-down structure of claim 1, wherein the through hole has a corresponding shape to that of the voltage step-down element.

5. The voltage step-down structure of claim 1, wherein the edge of the through hole is mounted with an insulation member.

* * * * *